US009156595B2

(12) United States Patent
Pace et al.

(10) Patent No.: US 9,156,595 B2
(45) Date of Patent: Oct. 13, 2015

(54) TAMPER EVIDENT LID AND CONTAINER

(71) Applicant: D&W Fine Pack, Elk Grove Village, IL (US)

(72) Inventors: Steve Pace, Elk Grove Village, IL (US); George A Golota, Glenview, IL (US); Andrei Voitnya, Chicago, IL (US)

(73) Assignee: D&W Fine Pack, Elk Grove Village, IL (US)

( * ) Notice: Subject to any disclaimer, the term of this patent is extended or adjusted under 35 U.S.C. 154(b) by 82 days.

(21) Appl. No.: 13/935,957

(22) Filed: Jul. 5, 2013

(65) Prior Publication Data

US 2015/0008222 A1 Jan. 8, 2015

(51) Int. Cl.
*B65D 17/34* (2006.01)
*B65D 43/02* (2006.01)

(52) U.S. Cl.
CPC .. *B65D 43/0252* (2013.01); *B65D 2543/00092* (2013.01); *B65D 2543/00296* (2013.01); *B65D 2543/00509* (2013.01); *B65D 2543/00537* (2013.01); *B65D 2543/00555* (2013.01); *B65D 2543/00685* (2013.01); *B65D 2543/00796* (2013.01); *B65D 2543/00842* (2013.01)

(58) Field of Classification Search
CPC ..... B65D 43/0252; B65D 2543/00842; B65D 2543/00796; B65D 2543/00296; B65D 2543/00537; B65D 2543/00509; B65D 2543/00092; B65D 2543/00555; B65D 2543/00685
USPC ..... 220/266, 276, 270, 791, 269, 260, 265; 215/250, 253, 254, 256
See application file for complete search history.

(56) References Cited

U.S. PATENT DOCUMENTS

| | | | | |
|---|---|---|---|---|
| 4,487,329 | A † | 12/1984 | Winstead | |
| 8,672,166 | B2 † | 3/2014 | Nazareth | |
| 2002/0125250 | A1 * | 9/2002 | Fang | 220/266 |
| 2004/0094553 | A1 † | 5/2004 | Crider | |
| 2006/0006178 | A1 † | 1/2006 | Foldesi, Sr. | |
| 2007/0012710 | A1 † | 1/2007 | Vovan | |
| 2008/0302798 | A1 * | 12/2008 | Foldesi, Sr. | 220/276 |
| 2010/0084401 | A1 * | 4/2010 | Golota et al. | 220/270 |

* cited by examiner
† cited by third party

*Primary Examiner* — Robert J Hicks
*Assistant Examiner* — Kareen Rush

(57) ABSTRACT

Embodiments relate to a tamper evident lid formed of a thermoformed material for use with a container. The lid includes a round, substantially planar surface having a periphery defining a surface circumference. The lid further includes an engagement portion surrounding the periphery and extending there from. The engagement portion includes a friction fit portion extending generally upward from the planar surface; and a tear away portion removably connected to the friction fit portion and being generally parallel to the friction fit portion.

20 Claims, 31 Drawing Sheets

TAMPER EVIDENT LID AND CONTAINER

FIELD OF THE INVENTION

The invention generally relates to containers. More particularly, embodiments relate to a tamper evident lid used with a nestable container.

BACKGROUND OF THE INVENTION

Sealable storage containers are often used to store items such as food, medicine, and the like. Such items are potentially dangerous to if they have been contaminated before reaching the consumer. It is often difficult to determine whether the container has been previously tampered with or opened merely by examining the items themselves because many items do not provide an observable indication that they have been tampered with or contaminated.

Thus, many producers of such items package their items in such a way that a consumer may readily examine a container and determine whether the contents of the container may have been tampered with after the item was packaged within the container. Such packaging often involves a seal or other indicia, either associated with the lid, the container, or both, that is broken or otherwise altered when the container is initially opened so that the seal or indicia cannot be replaced or repaired in the same condition. Thus, a seal or indicia in a condition different from its initial condition indicates to a consumer that the contents of the container should not be used because they may have been contaminated.

Many existing lids with tamper-evident features have several disadvantages. For example, existing tamper-evident lids are often not resealable. Thus, once the tamper-evident feature has been broken, the lid does not reseal to the container. Rather, the lid has a loose fit atop the container and often falls off when the container is moved or even slightly inverted. Other existing tamper-evident lids include multiple tamper-evident features (e.g., vertical membranes, perforations, or the like), thereby making the lid more susceptible to accidental breakage of the tamper-evident feature. It would be desirable to provide a container assembly that addresses these disadvantages and provides tamper-evidence to a consumer.

The present invention advances the art providing a lid used with a container that is readily tamper evident, not susceptible to leakage and resealable.

BRIEF SUMMARY OF THE INVENTION

One embodiment of the invention provides a tamper evident lid used with a nestable container. Embodiments relate to a tamper evident lid formed of a thermoformed material for use with a container. The lid includes a round, substantially planar surface having a periphery defining a surface circumference. The lid further includes an engagement portion surrounding the periphery and extending therefrom. The engagement portion includes a friction fit portion extending generally upward from the planar surface; and a tear away portion removably connected to the friction fit portion and being generally parallel to the friction fit portion.

Yet other embodiments relate to a tamper evident lid formed of a thermoformed material. The lid includes a substantially planar surface having a periphery defining a surface circumference and an engagement portion surrounding the periphery and extending there from. The engagement portion includes a friction fit portion extending generally upward from the planar surface; a shoulder engaging the friction fit portion; and a depending tear away portion removably connected to the shoulder and being generally parallel to the friction fit portion.

Still other embodiments relate to a tamper evident container formed of a thermoformed material including a tray and a tamper evident lid for use with the tray. The tray includes a round open end having a lip extending around a circumferential edge, the lip having an inside edge and an outside edge; a round closed end; a sidewall extending between the open end and the round closed end and defining an interior. The tamper evident lid includes a round, substantially planar surface having a periphery defining a surface circumference; and an engagement portion surrounding the periphery and extending there from. The engagement portion includes a friction fit portion extending generally upward from the planar surface; and a tear away portion removably connected to the friction fit portion and being generally parallel to the friction fit portion.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention can be defined by the appended the claims and equivalents thereof.

BRIEF DESCRIPTION OF THE SEVERAL VIEWS OF THE DRAWINGS

Throughout the various figures, like reference numbers refer to like elements.

DETAILED DESCRIPTION

Figure 1:
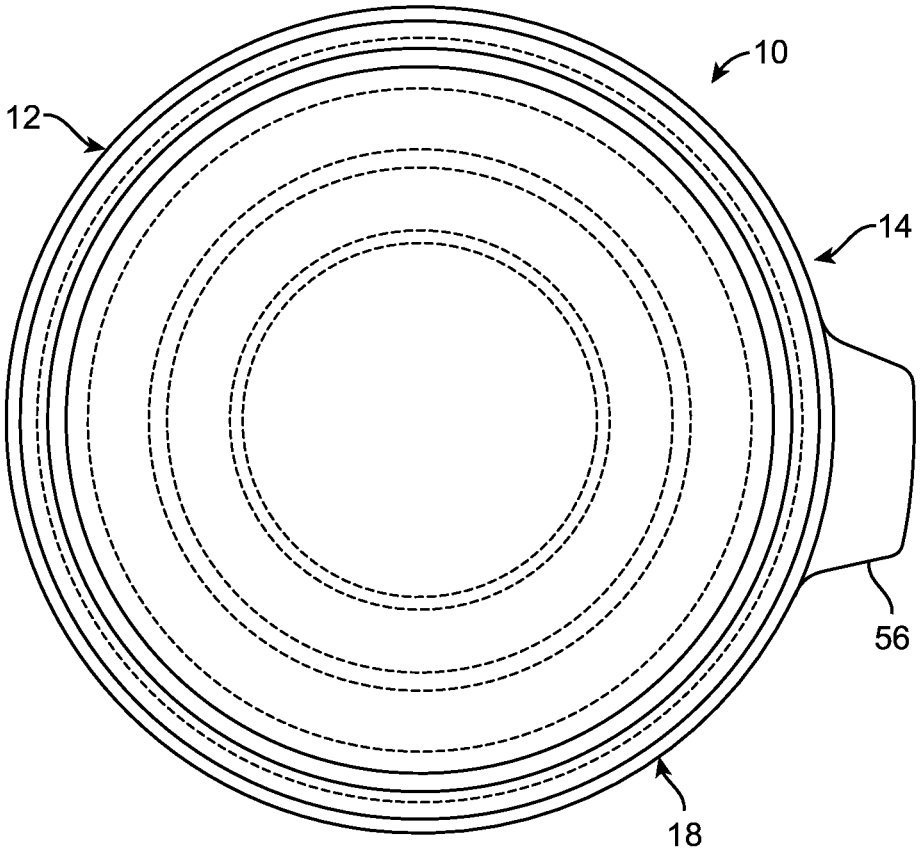
FIG. 1 is top view of the container in accordance with one embodiment of the present invention.
Figure 2:
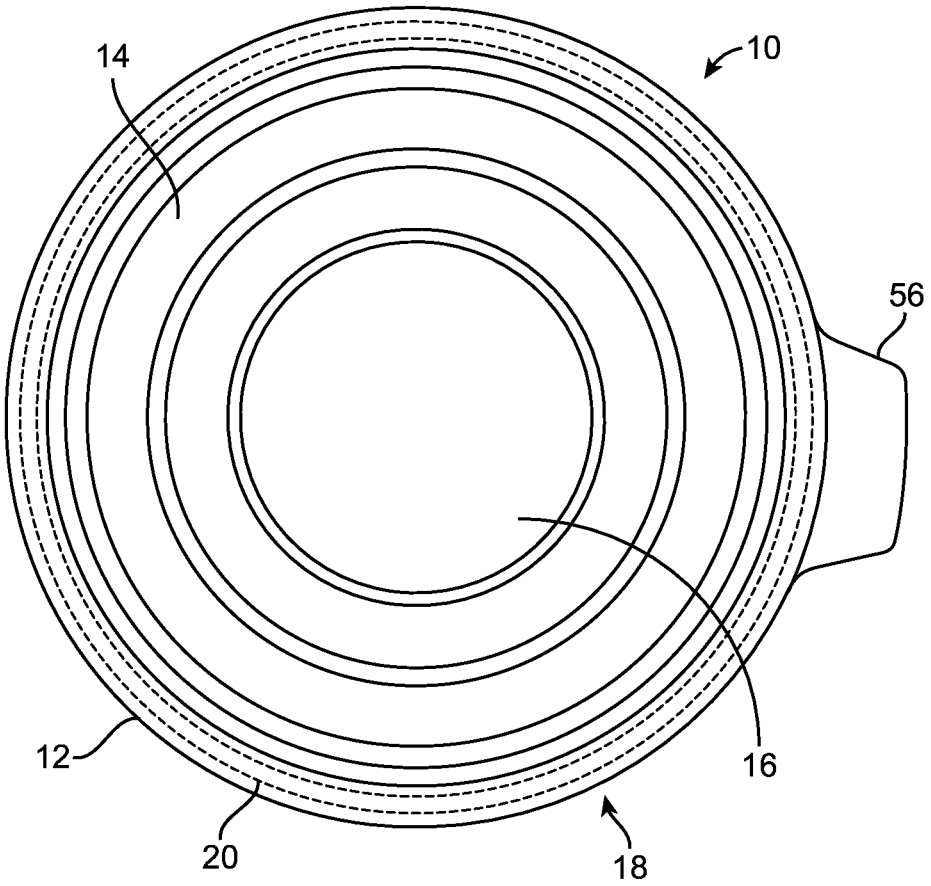
FIG. 2 is bottom view of the container of FIG. 1 in accordance with one embodiment of the present invention.
Figure 3:
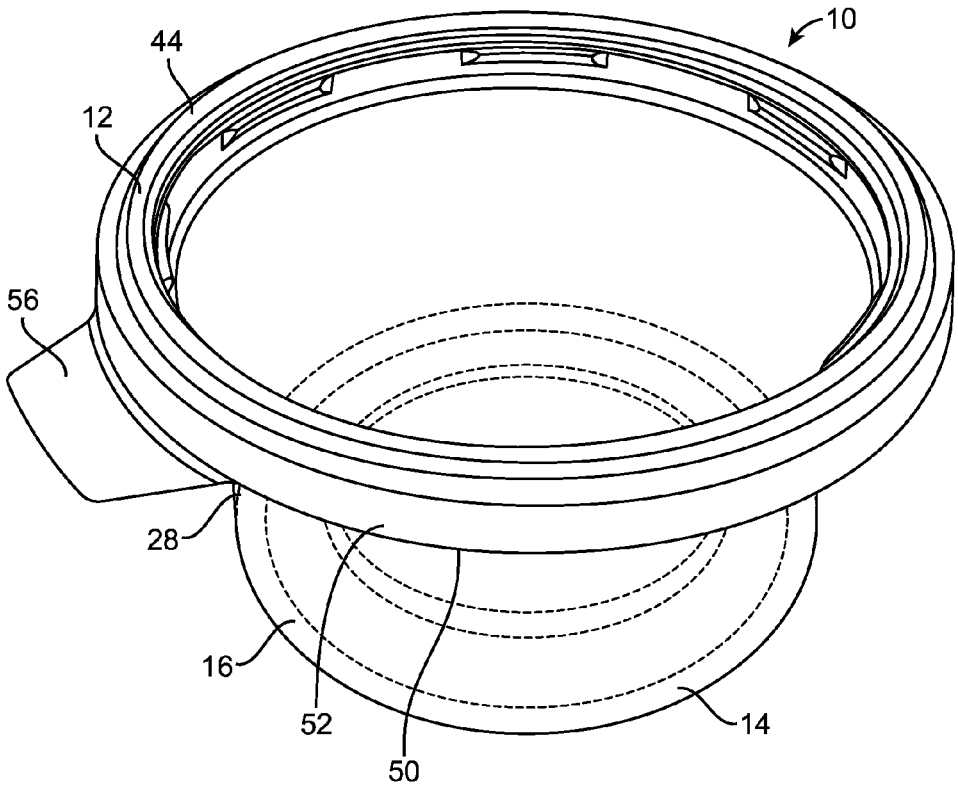
FIG. 3 is perspective view of the container of FIG. 1 in accordance with one embodiment of the present invention.
Figure 4:
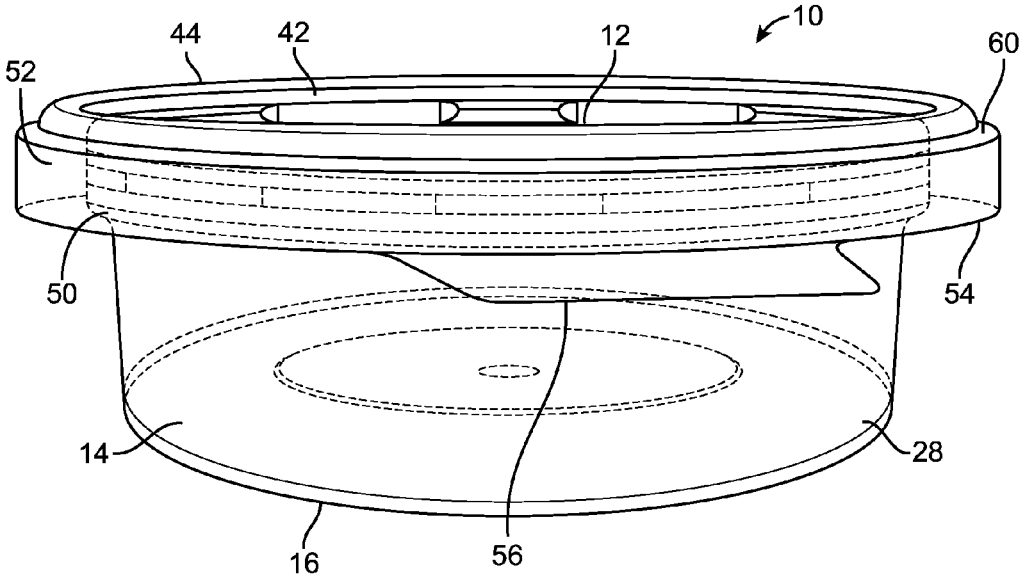
FIG. 4 is front view of the container of FIG. 1 in accordance with one embodiment of the present invention.
Figure 5:
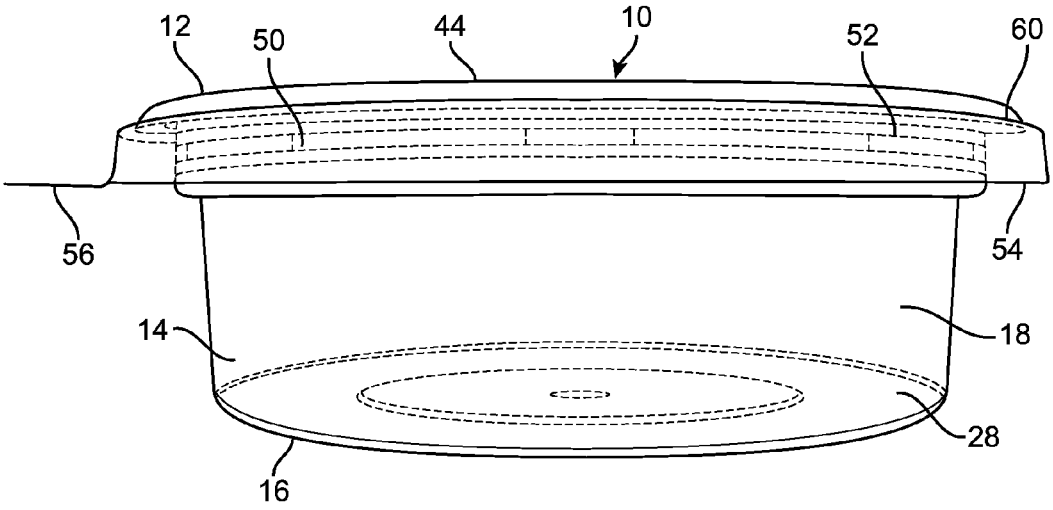
FIG. 5 is left side view of the container of FIG. 1 in accordance with one embodiment of the present invention.
Figure 6:
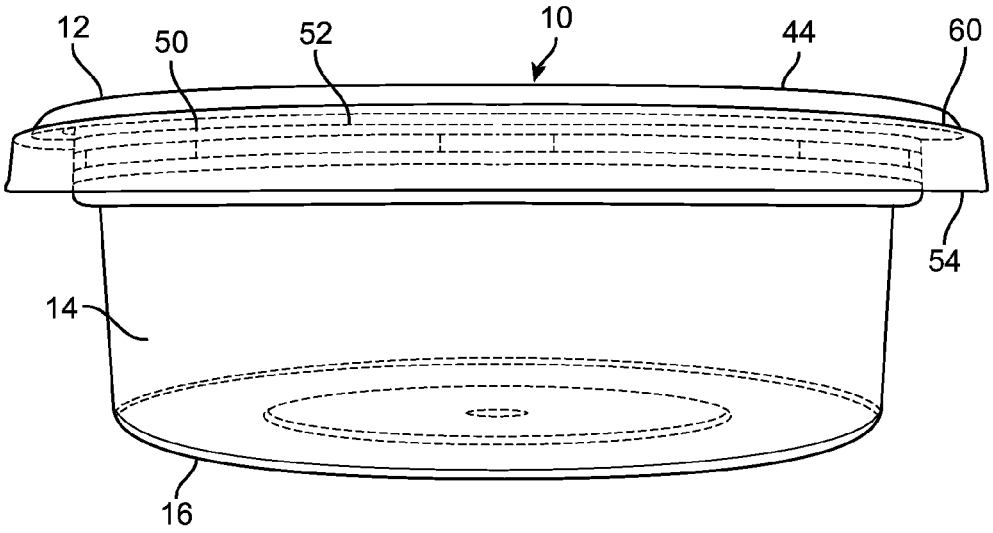
FIG. 6 is rear view of the container of FIG. 1 in accordance with one embodiment of the present invention.
Figure 7:
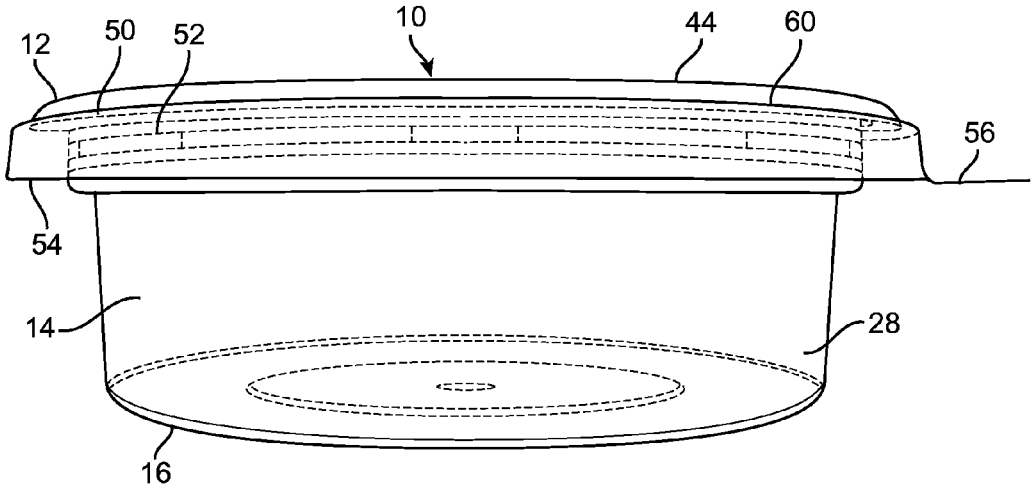
FIG. 7 is right side view of the container of FIG. 1 in accordance with one embodiment of the present invention.

FIG. 1-11 illustrates a container 10 according to one embodiment. More specifically, FIGS. 1-7 illustrate top, bottom, perspective, front, left, rear and right side views of the container 10 including a lid 12 and a body or tray 14. The container 10 may be thermoformed from a suitable polymer, such as polyurethane, polypropylene, polyethylene, polyethylene terephthalate, polyester, polyvinyl chloride, another type of thermoplastic polymer, or a suitable combination of polymers. While the above materials are disclosed, other materials are contemplated. Furthermore it is contemplated that the lid 12 and tray 14 are comprised of the same materials. However, embodiments are contemplated in which lid 12 and tray 14 are comprised of different materials. Furthermore, while a thermoformed process is disclosed, other forming processes are contemplated.

Although the container 10 of the illustrated embodiments is generally cylindrical in shape, it is contemplated that the container 10 may have other suitable shapes including, for example, oval, square, rectangular, and other polygonal or non-polygonal shapes. Further, the container 10 may be sized to hold any suitable amount of contents (e.g., food, liquids, or other items). The width of the container 10 (FIG. 3-4) is generally tapered such that the open end 18 has the greatest width, and the bottom end 16 has the smallest width. This tapering feature assists in allowing two or more like containers 10 to be stacked or nested.

Figure 9:
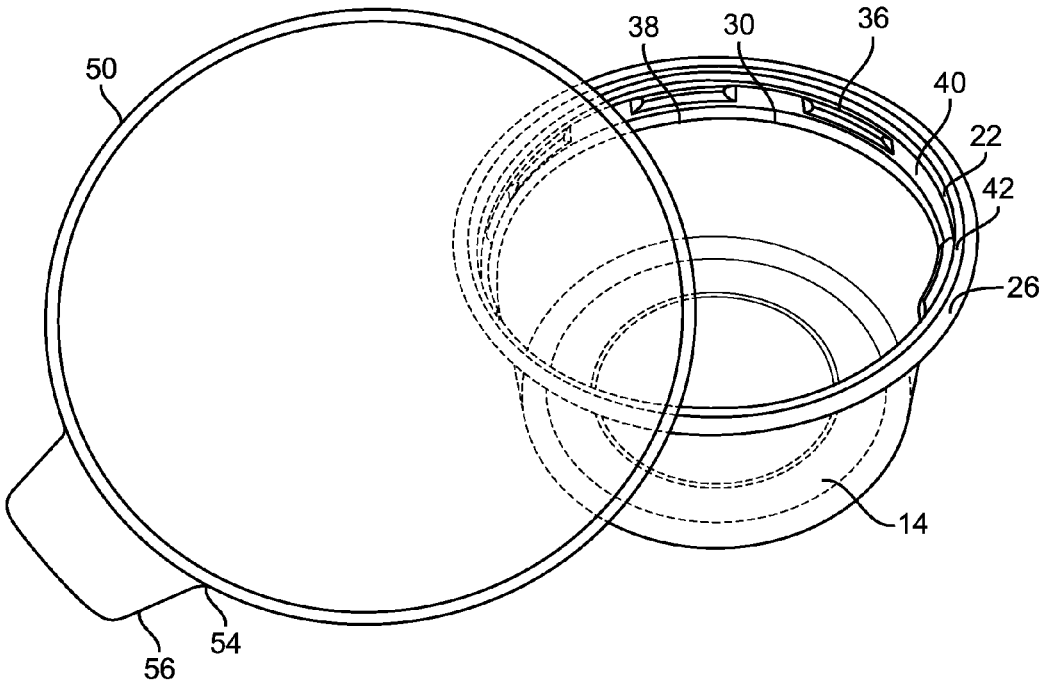
FIG. 9 is another perspective view of the container of FIG. 8 illustrating opening the container in accordance with one embodiment of the present invention.
Figure 10:
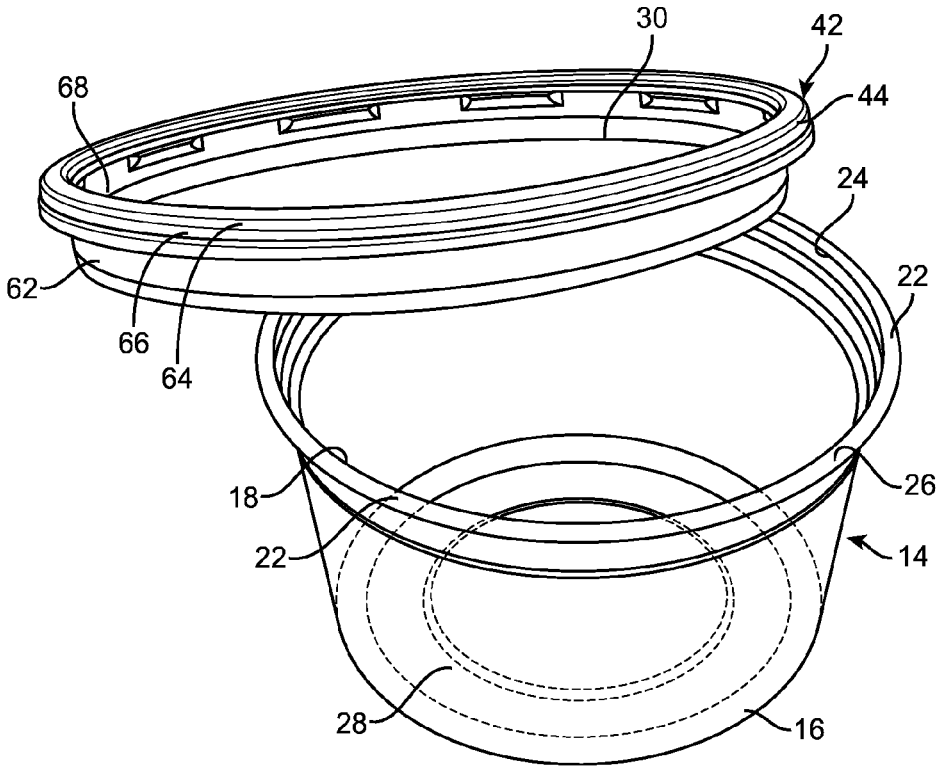
FIG. 10 is yet another perspective view of the container of FIG. 8 illustrating opening the container in accordance with one embodiment of the present invention.
Figure 11:
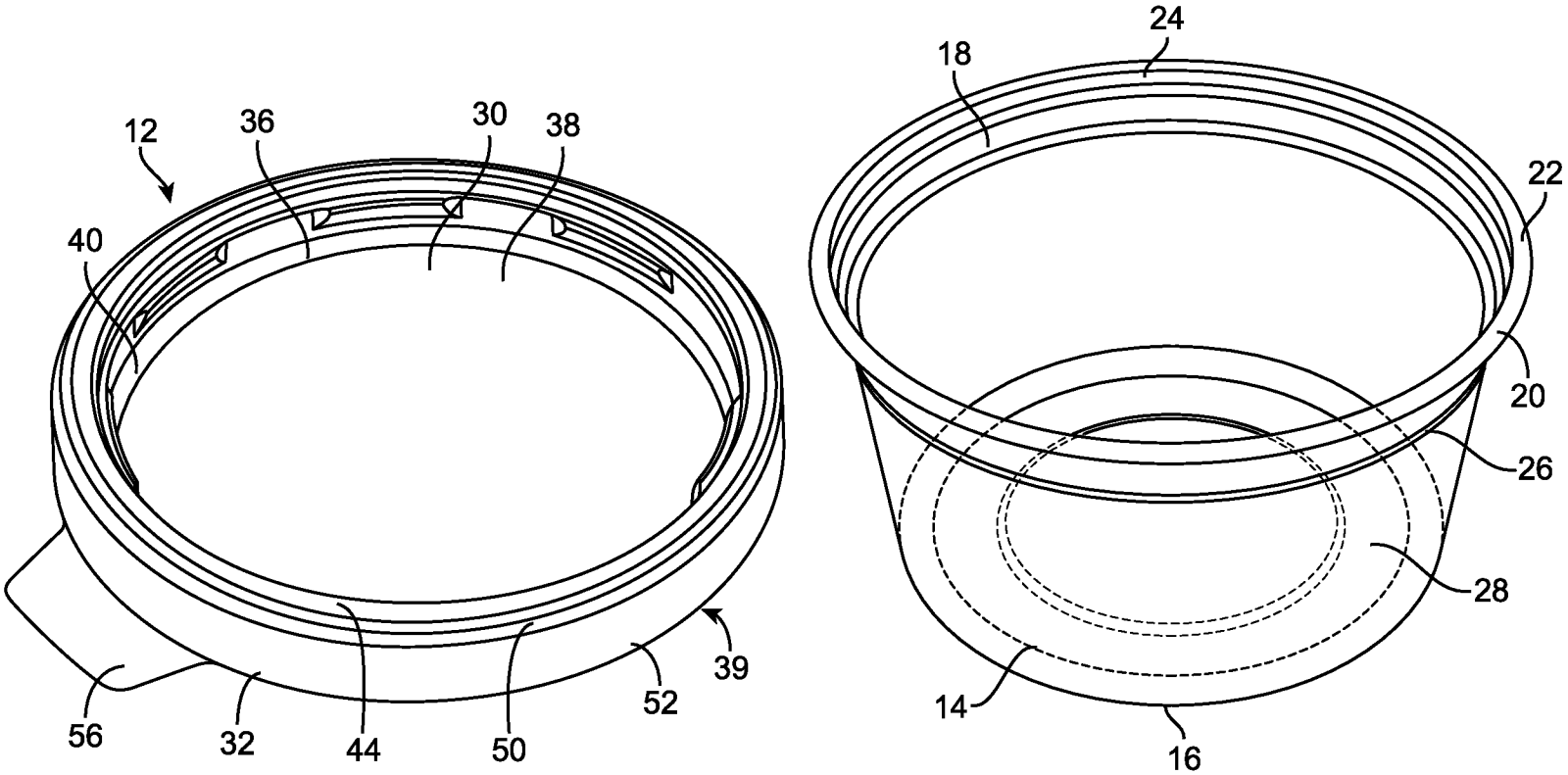
FIG. 11 is a partially exploded view of the container of FIG. 8 in accordance with one embodiment of the present invention.
Figure 12:
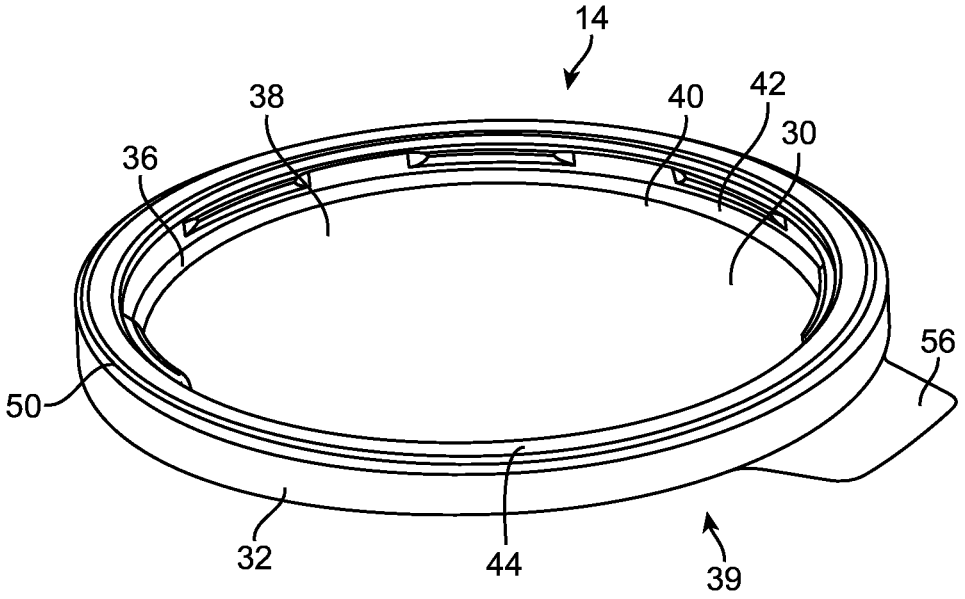
FIG. 12 is a perspective view of the lid of FIG. 1 depicting the planar portion and the tear away portion in accordance with one embodiment of the present invention.
Figure 13:
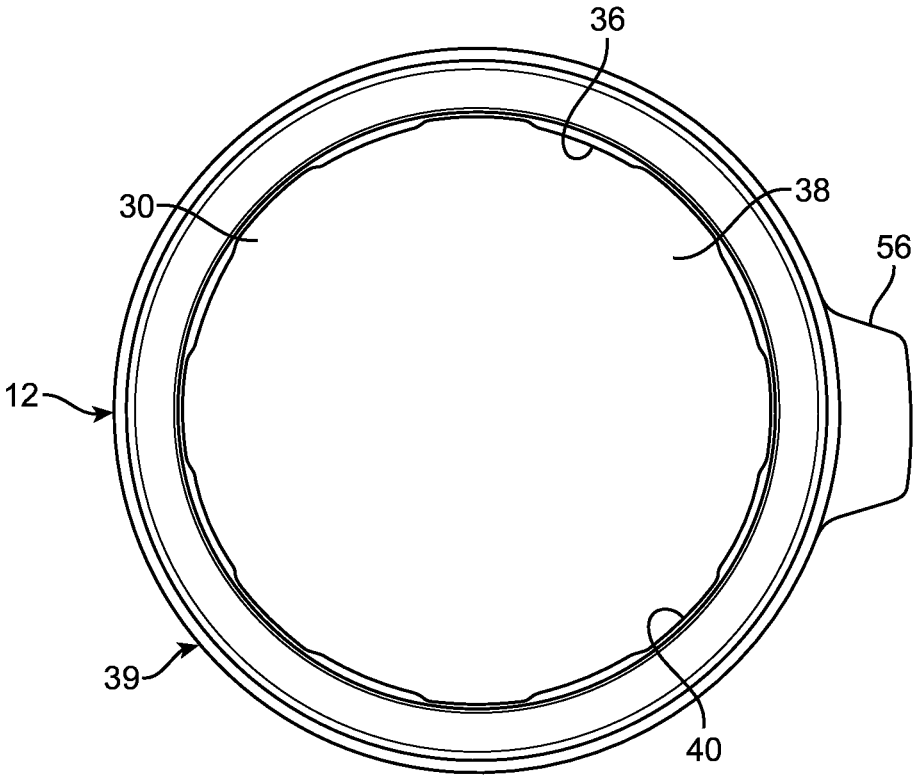
FIG. 13 is a top view of the lid of FIG. 12 in accordance with one embodiment of the present invention.
Figure 14:
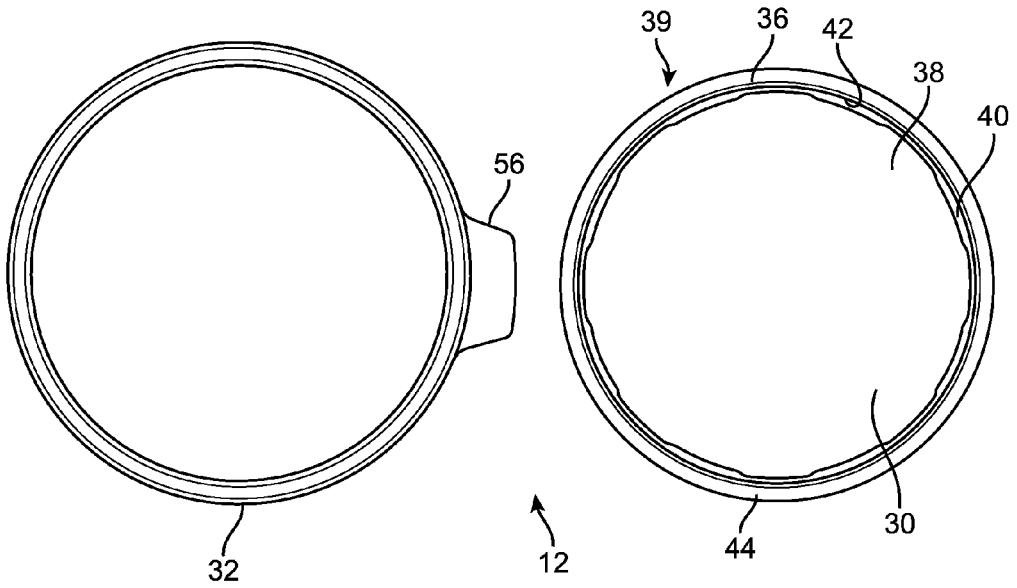
FIG. 14 is a top exploded view of the lid of FIG. 13 depicting the planar portion and the tear away portion an open arrangement in accordance with one embodiment of the present invention.
Figure 15:
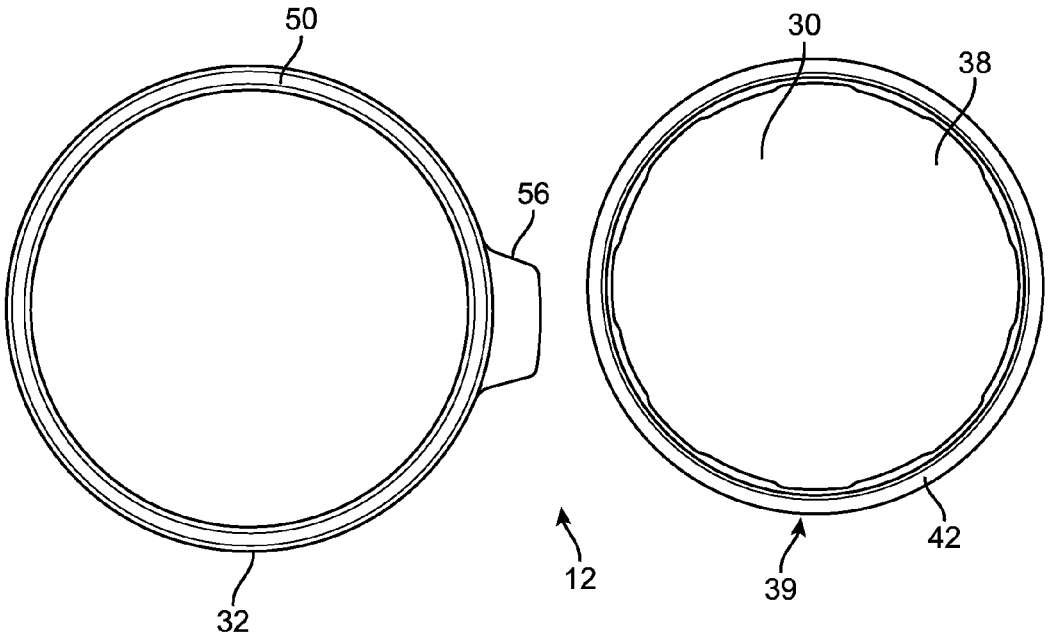
FIG. 15 is a bottom view of the planar portion and tear away portion of FIG. 14 in accordance with one embodiment of the present invention.
Figure 16:
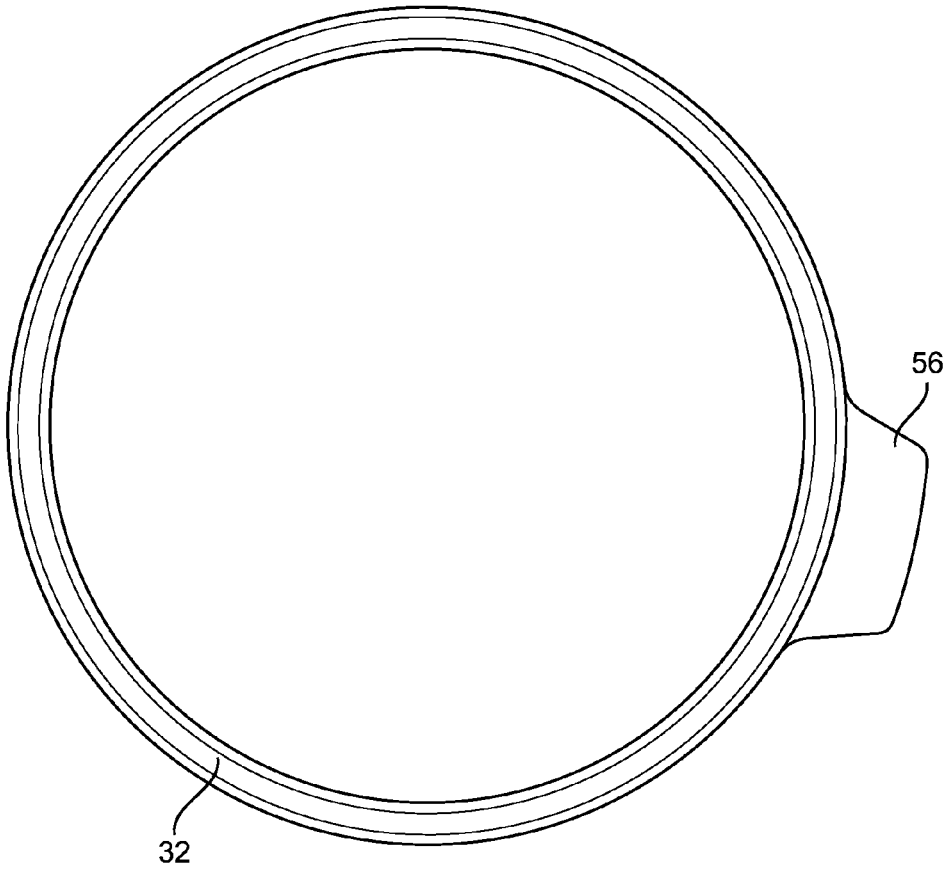
FIG. 16 is a bottom view of the tear away portion of the lid of FIG. 12 in accordance with one embodiment.
Figure 17:
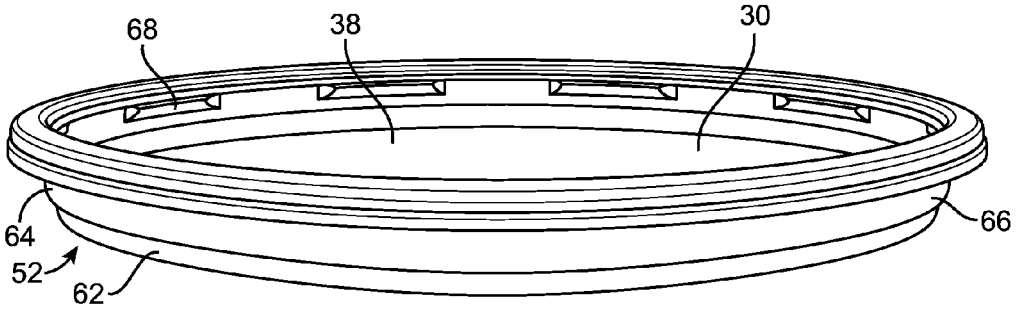
FIG. 17 is a front view of the planar portion of the lid of FIG. 12 in accordance with one embodiment, the side and back views being mirror images thereof.
Figure 18:
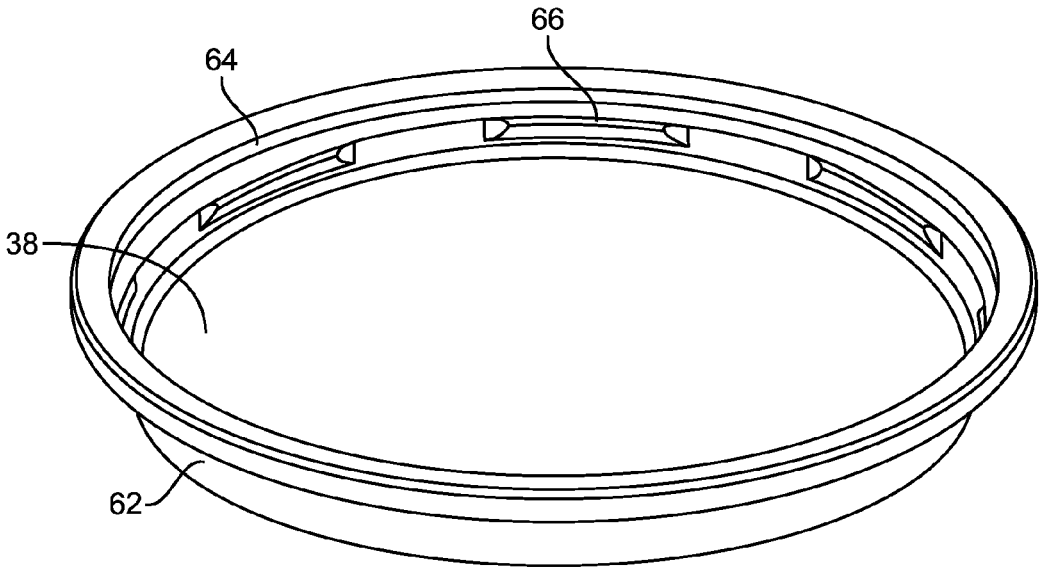
FIG. 18 is a perspective view of the planar portion of the lid of FIG. 17 in accordance with one embodiment
Figure 19:
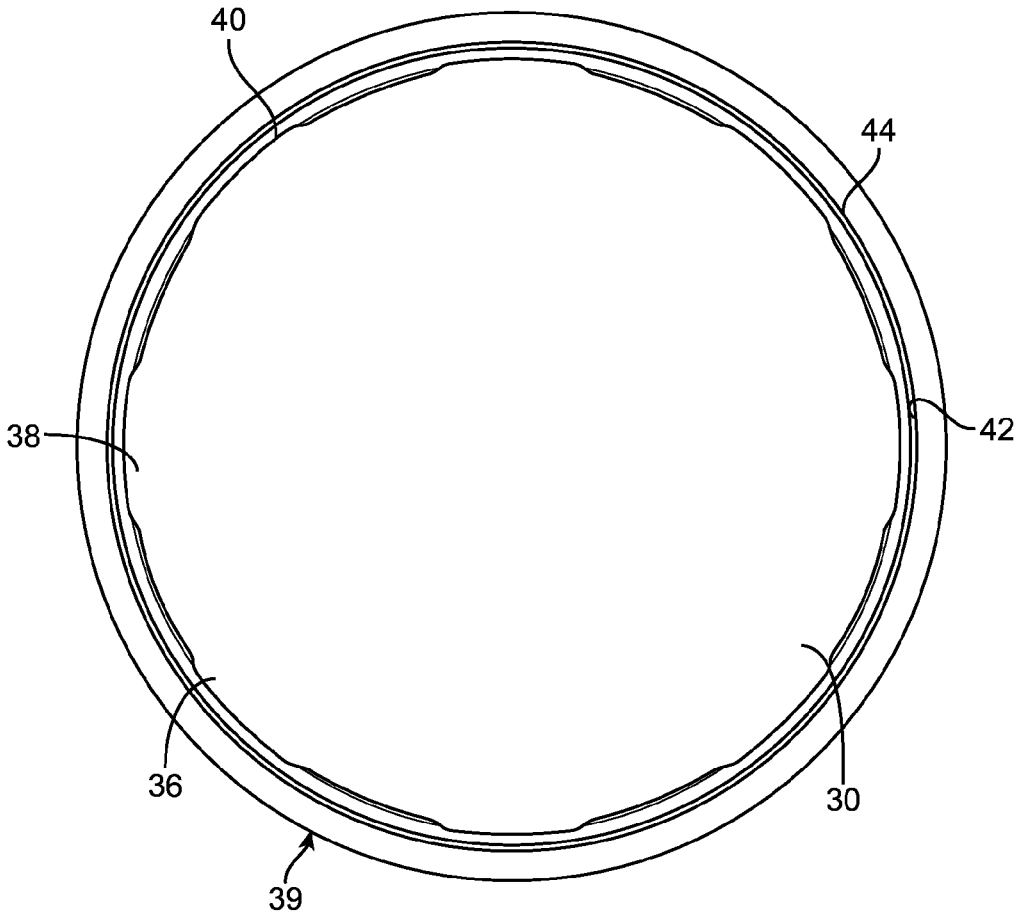
FIG. 19 is a top view of the planar portion of the lid of FIG. 17 in accordance with one embodiment.
Figure 20:
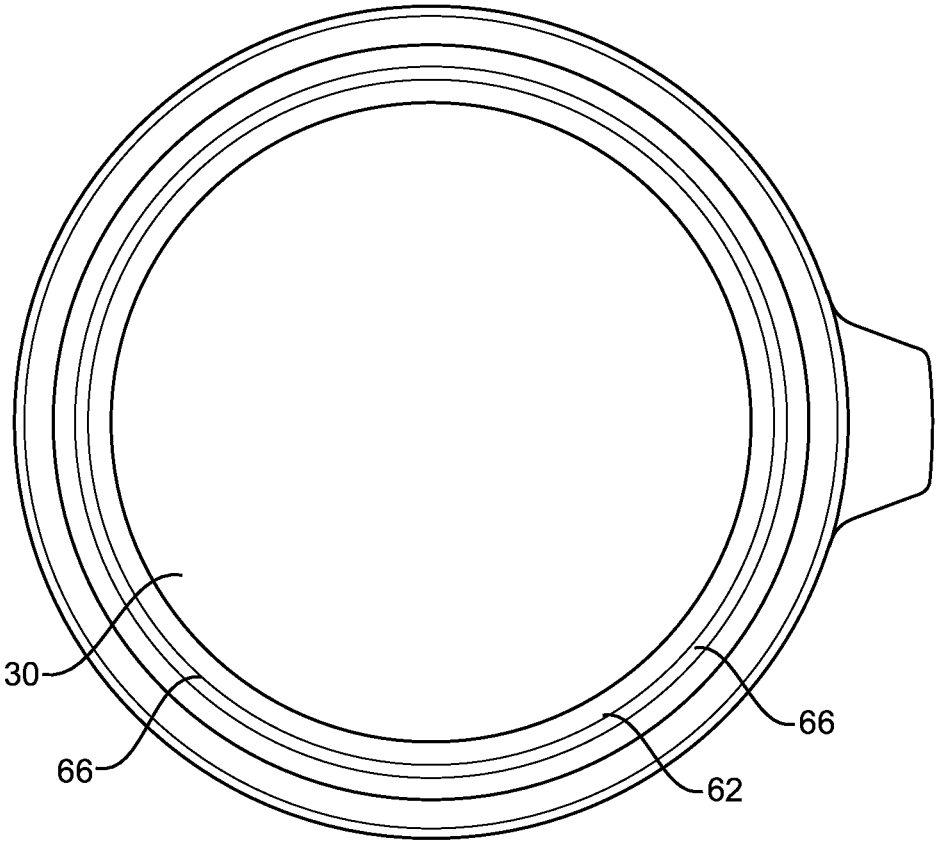
FIG. 20 is a bottom view of the planar portion of the lid of FIG. 17 in accordance with one embodiment.

As illustrated in FIGS. 1-7, tray 14 is depicted having a round closed bottom end 16 and a round open end 18 with a lip 20 (best viewed in FIG. 2) extending around a circumferential edge 22, the lip 20 having an inside edge 24 and an outside edge 26 (best viewed in FIGS. 9-11). The tray 14 further includes a sidewall 28 extending between closed bottom end 16 and open end 18. The lip 20 assists in adding strength to the container 10. Furthermore, as will be described in more detail below, the lip 20 assists in forming a seal with the lid 12 such that contents of the container 10 are prevented from spilling out from the container 10.

FIGS. 11-20 depict the lid 12 in accordance with embodiments of the invention. As illustrated in FIGS. 11-20, lid 12 includes planar portion 30 and the tear away portion 32 in accordance with one embodiment of the present invention. The illustrated lid 12 may be thermoformed from a suitable polymer, such as polyurethane, polypropylene, polyethylene, polyethylene terephthalate, polyester, polyvinyl chloride, another type of thermoplastic polymer, or a suitable combination of polymers. While the above materials are disclosed, other materials are contemplated. Furthermore, while a thermoformed process is disclosed, other processes are contemplated. Although the lid 12 of the illustrated embodiments is generally round in shape, it is contemplated that the lid 12 may have other suitable shapes including, for example, oval, square, rectangular, and other polygonal or non-polygonal shapes.

As illustrated, lid 12 includes a substantially planar portion 30 having a periphery 36 defining a surface 38 and a surface circumference 40. The lid 12 further includes an engagement portion 39 surrounding the periphery 36 and extending therefrom. The engagement portion 39 includes a friction fit portion 42 extending generally upward from the planar surface 38 at surface circumference 40.

Lid 12 further comprises a shoulder 44 that engages and extends from friction fit portion 42. In at least one embodiment, the shoulder 44 defines a plane generally parallel to a plane defined by surface 38.

The tear away portion 32 further includes a tear away portion 50 connected to the friction fit portion 42 at shoulder 44. In at least one embodiment, the tear away portion 50 defines a plane generally parallel to a plane defined by the friction fit portion 42. The tear away portion 50 comprises a depending portion 52 extending generally downward from the shoulder 42 and removably connected thereto.

In one or more embodiments, the depending portion 52 defines a plane generally parallel to the plane defined by the friction fit portion 42. The depending portion 52 has a distal end 54 that does not extend below a plane defined by the surface 38. More specifically the distal end 54 is on a plane defined by the surface 38. The lid 12 further includes at least one tab 56 extending outwardly from the tear away portion 50, at distal end 54 for example.

In at least one embodiment, the tear away portion 50 includes a frangible portion 60 removably engaging the shoulder 44 and the tear away portion. The frangible portion 60 is a perforated section selected from a shape including a wave-form, zig-zag, saw-tooth or a straight line.

In the embodiment illustrated in FIGS. 11-18 the friction fit portion 42 includes a first ridge portion 62 engaging or integral with and extending from the surface 38 at an angle between 60° and 120° but generally at approximately 90° thereto. The friction fit portion 42 further includes a second ridge portion 64 engaging and integral with shoulder 44 and extending between a ridge 66 and the shoulder 44.

In at least one embodiment, the first ridge portion 62 has a circumference greater than the surface circumference 40, the ridge 66 has a circumference substantially equal to the circumference of the first ridge portion 62, while the second ridge portion 64 has circumference smaller than the circumference of the first ridge portion 62 and/or ridge 66. Further, the lid 12 may include one, two or more indents 68 extending about the circumference of the second ridge portion 64 and extending inwardly towards the center of the surface 38. This arrangement of the first ridge portion 62, second ridge portion 64, ridge 66 and/or one or more indents 68 provides good structural support to the lid 12, providing a good friction fit with the tray 14, but enabling the lid 12 to be removed by the consumer.

Figure 8:
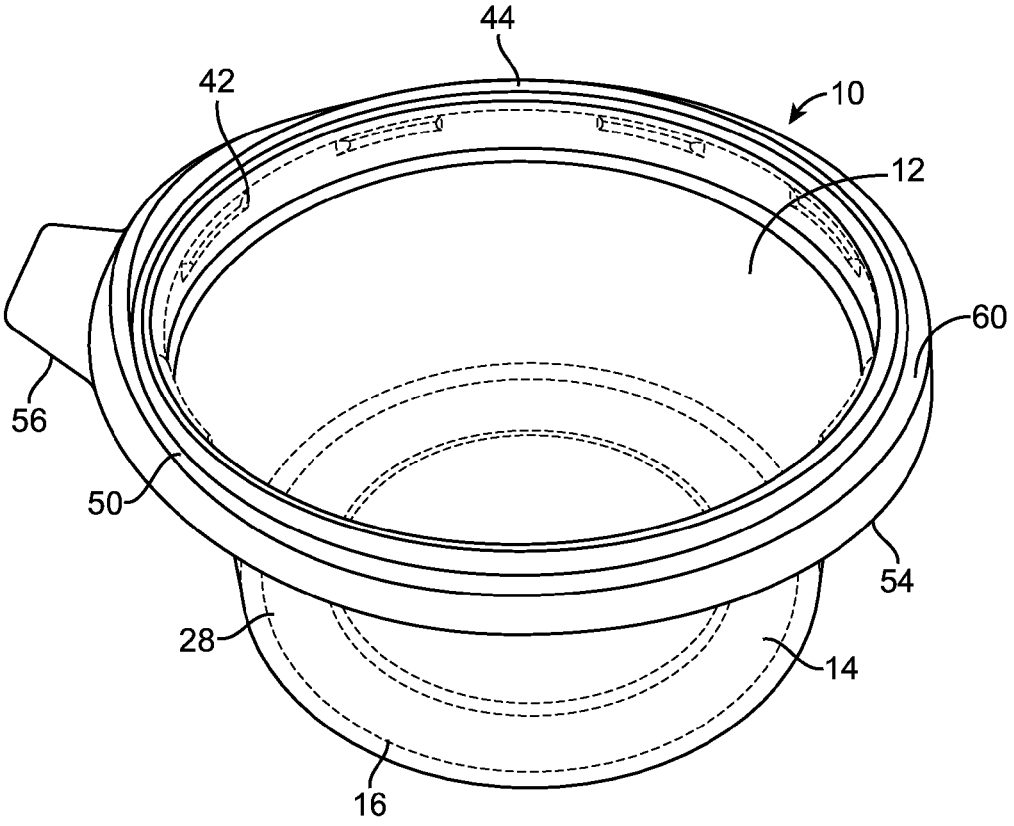
FIG. 8 is another perspective view of the container of FIG. 1 illustrating opening the container in accordance with one embodiment of the present invention.

According to one embodiment illustrated in FIGS. 8-11, to remove the lid 12 from the tray 14, a consumer generally grasps the tab 56 and pulls up (best illustrated in FIG. 8). This action causes the tear away portion 32 to break or tear at the frangible portion 60 (best viewed in FIG. 9) resulting in the tear away portion 32 and planar portion 30 forming or breaking into two separate parts (See FIGS. 14-15) and leaving the planar portion 30 engaging and in a friction fit with the tray 14. This is desirable because it allows for the lid 12 to be resealed to the tray 14 after the lid 12 has been initially removed.

The friction fit is formed by the first ridge portion 62 removable engaging an inner surface of the sidewall 28 and the shoulder engaging the inside edge 24 and/or lip 20, such that the contents are prevented from spilling out from the container 10. Additionally, the ridge 66 and/or second ridge portion 64 may be in contact with the inner surface of the side wall 28 and/or the inside edge 24.

The planar portion 30 may be grasped by the user and removed, allowing the user access to the contents of the tray 14. The planar portion 30 may be placed back on the tray 14 is a resealable manner, such that the first ridge portion 62 removable engages the inner surface of the sidewall 28, the shoulder 42 engages the inside edge 24 and/or lip 20; and/or the ridge 66 and/or second ridge portion 64 may be in contact with the inner surface of the side wall 28 and/or the inside edge 24.

FIGS. 21-25 depict a container 110 in accordance with another embodiment, similar to that as provided above. More specifically, FIGS. 21-25 illustrate the container 110 including a lid 112 and a body or tray 114. The container 110 may be thermoformed from a suitable polymer, such as polyurethane, polypropylene, polyethylene, polyethylene terephthalate, polyester, polyvinyl chloride, another type of thermoplastic polymer, or a suitable combination of polymers. While the above materials are disclosed, other materials are contemplated. Furthermore it Is contemplated that the lid 112 and tray 114 are comprised of the same materials. However, embodiments are contemplated in which lid 112 and tray 114 is comprised of different materials. Furthermore, while a thermoformed process is disclosed, other forming processes are contemplated.

Although the container 110 of the illustrated embodiments is generally cylindrical in shape, it is contemplated that the container 110 may have other suitable shapes including, for example, oval, square, rectangular, and other polygonal or non-polygonal shapes. Further, the container 110 may be sized to hold any suitable amount of contents (e.g., food, liquids, or other items). In at least one embodiment, the width of the container 110 is generally tapered such that the open end 118 has the greatest width, and the bottom end 116 has the smallest width. This tapering feature assists in allowing two or more like containers 110 to be stacked or nested.

Figure 21:
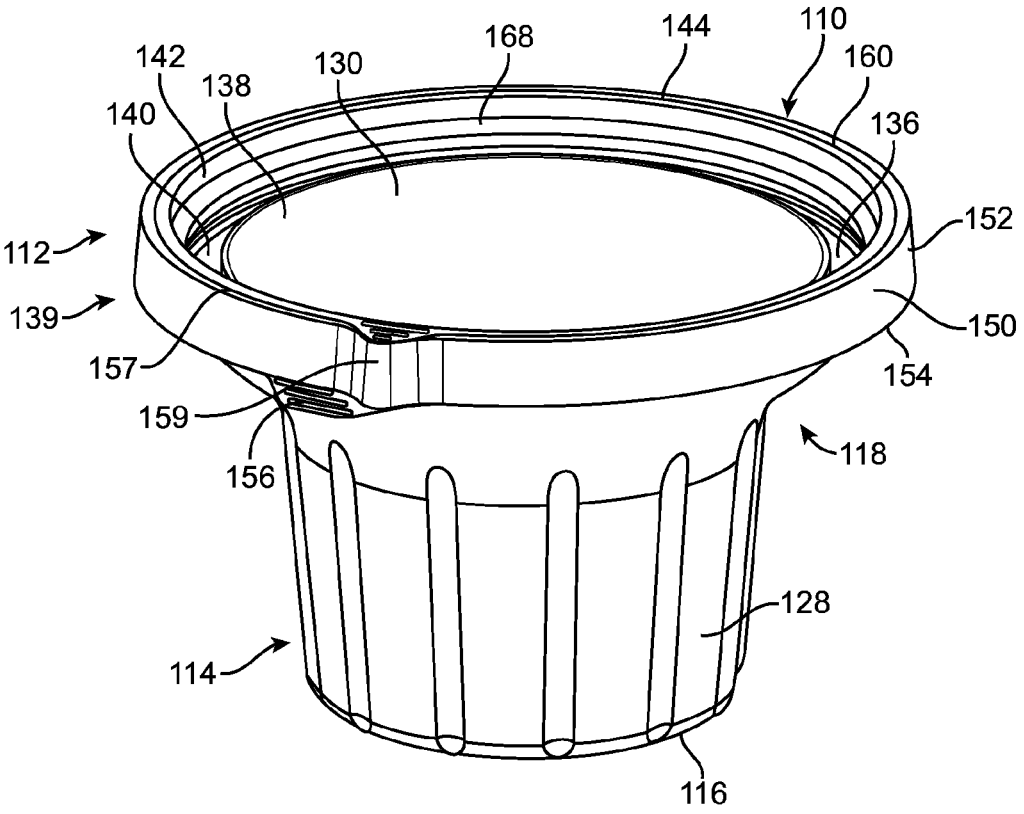
FIG. 21 is a perspective view of the container in accordance with another embodiment of the present invention.
Figure 22:
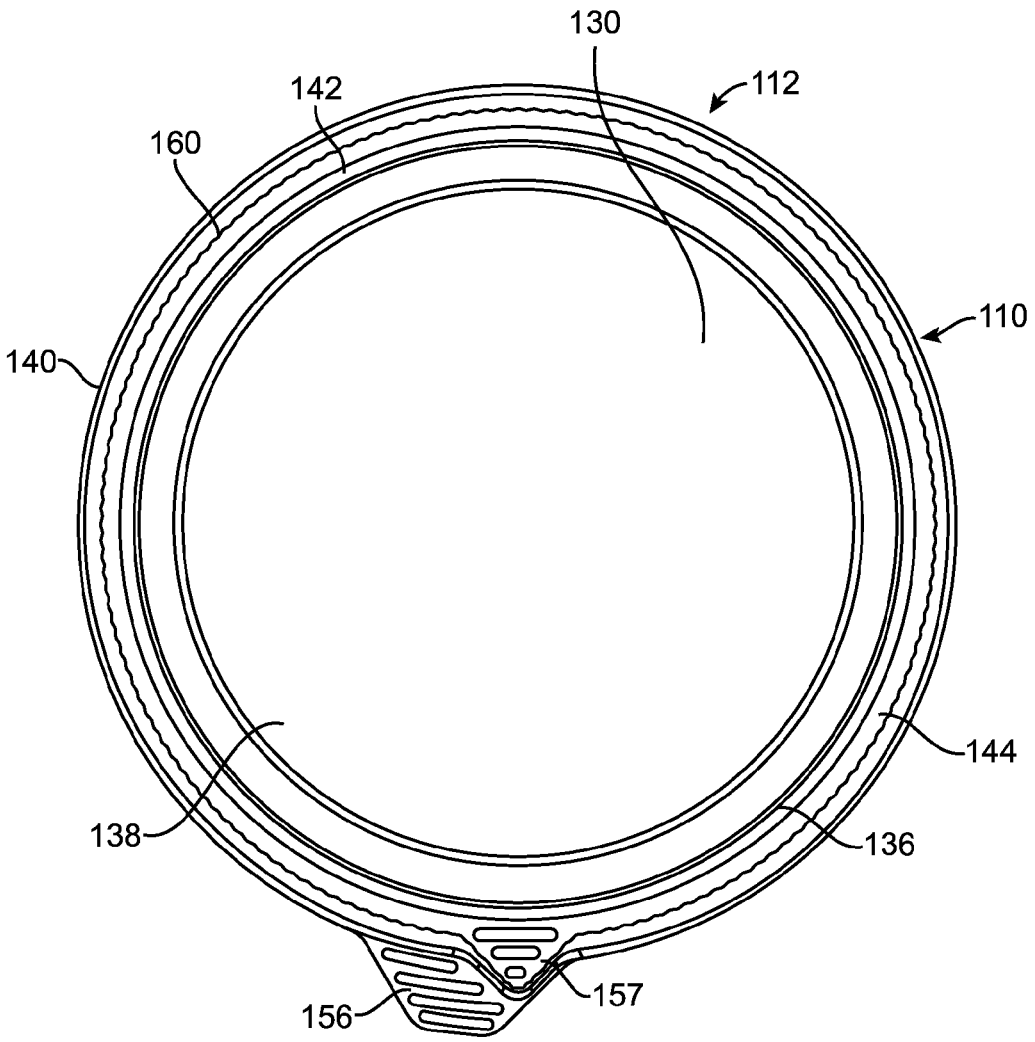
FIG. 22 is top view of the container of FIG. 21 in accordance with one embodiment of the present invention.
Figure 23:
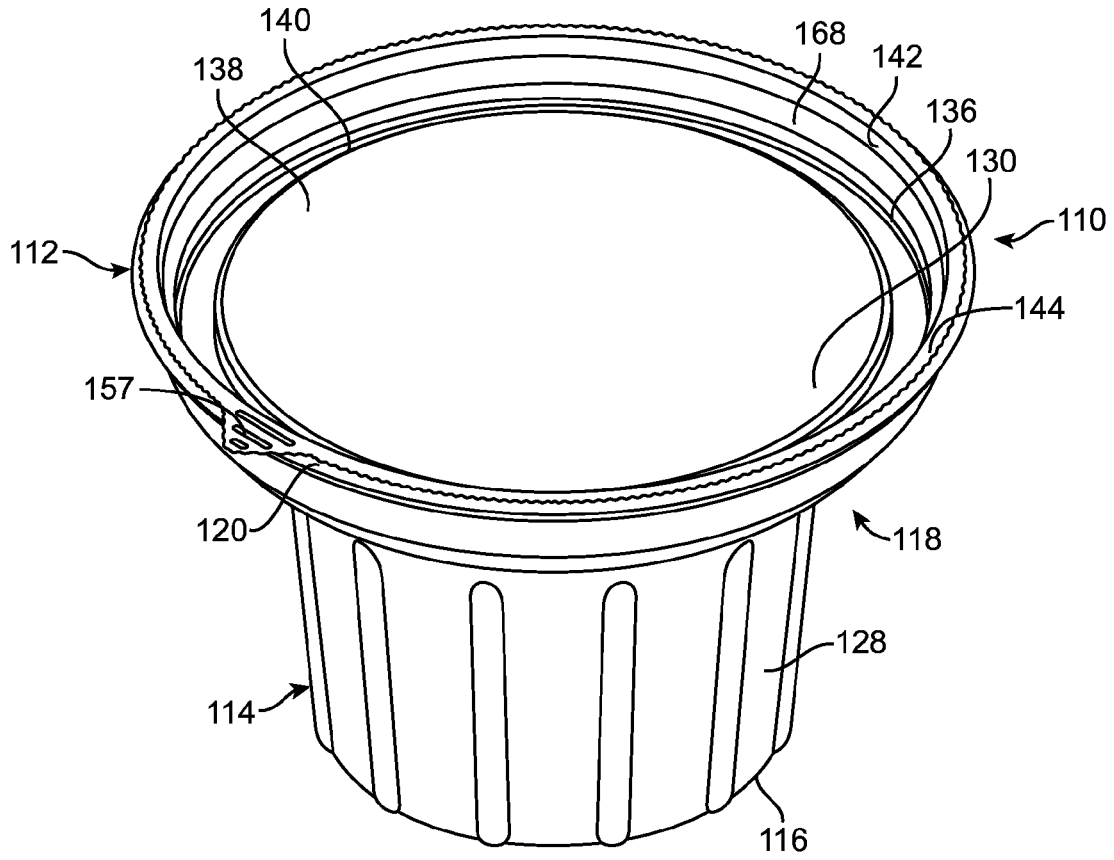
FIG. 23 is perspective view of the container of FIG. 21 having the tear away portion removed in accordance with one embodiment of the present invention.

As illustrated in FIGS. 21 and 23, tray 114 is depicted having a round closed bottom end 116 and a round open end 118 with a lip 120 extending around a circumferential edge, the lip having an inside edge and an outside edge. The tray 114 further includes a sidewall 128 extending between closed bottom end 116 and open end 118.

As illustrated in FIGS. 21-22 and 24-25, lid 112 includes planar portion 130 and the tear away portion 132 in accordance with one embodiment of the present invention. The illustrated lid 112 may be thermoformed from a suitable polymer, such as polyurethane, polypropylene, polyethylene, polyethylene terephthalate, polyester, polyvinyl chloride, another type of thermoplastic polymer, or a suitable combination of polymers. While the above materials are disclosed, other materials are contemplated. Furthermore, while a thermoformed process is disclosed, other processes are contemplated. Although the lid 112 of the illustrated embodiments is generally round in shape, it is contemplated that the lid 112 may have other suitable shapes including, for example, oval, square, rectangular, and other polygonal or non-polygonal shapes.

As illustrated, lid 112 includes a substantially planar portion 130 having a periphery 136 defining a surface 138 and a surface circumference 140. The lid 112 further includes an engagement portion 139 surrounding the periphery 136 and extending therefrom. The engagement portion 139 includes a friction fit portion 142 extending generally upward from the planar surface 138 at surface circumference 140.

Lid 112 further comprises a shoulder 144 that engages and extends from friction fit portion 142. In at least one embodiment, the shoulder 144 defines a plane generally parallel to a plane defined by surface 138.

The tear away portion 132 further includes a tear away portion 150 connected to the friction fit portion 142 at shoulder 144. In at least one embodiment, the tear away portion 132 defines a plane generally parallel to a plane defined by the friction fit portion 142. The tear away portion 150 comprises a depending portion 152 extending generally downward from the shoulder 142 and removably connected thereto.

In one or more embodiments, the depending portion 152 defines a plane generally parallel to the plane defined by the friction fit portion 142. The depending portion 152 has a distal end 154 that extends below a plane defined by the planar surface (See FIG. 24).

Lid 112 further includes a first tab 156; a second tab 157 and an extending portion 159 extending between the first tab 156 and second tab 157. In the embodiment illustrated in FIGS. 21 and 22-25, the first tab 156 has a trapezoidal shape for example extending outwardly from the tear away portion at distal end 154 for example, while the second tab 157 has a triangular shape and is coupled to the lid proximate shoulder 144. Extending portion 159 is coupled to the tear away portion 150, extending outwardly there from, and in contact with and engaging both the first tab 156 and the second tab 157. In the illustrated embodiment, the extending portion 159 is similar to or mirrors the shape of the second tab 157 although other embodiments are contemplated.

In at least one embodiment, the tear away portion 150 includes a frangible portion 160 removably engaging the shoulder and the tear away portion 150. In the illustrated embodiment, the frangible portion 160 extends about the second tab 157. The frangible portion 160 is a perforated section selected from a shape including a wave-form, zig-zag, saw-tooth or a straight line for example.

Figure 24:
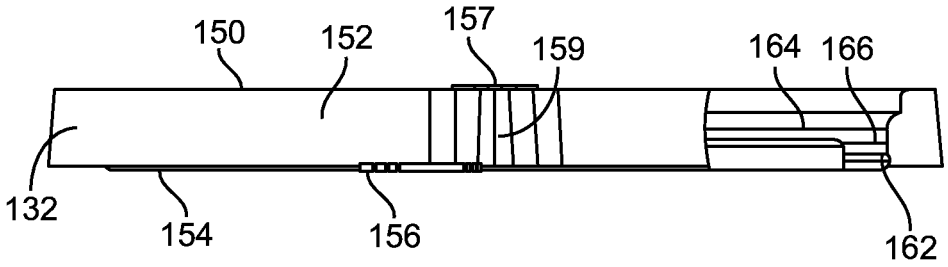
FIG. 24 is a partially cut away side front of the lid of the container of FIG. 21 in accordance with one embodiment of the present invention.
Figure 25:
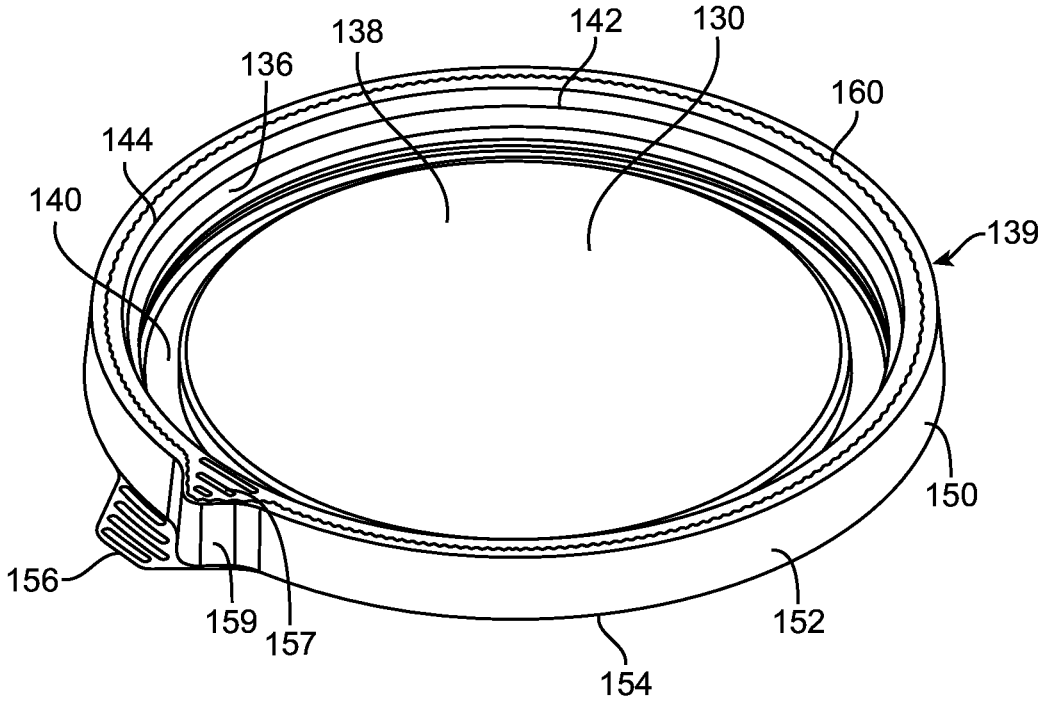
FIG. 25 is perspective view of the lid of the container of FIG. 21 in accordance with one embodiment of the present invention.
Figure 26:
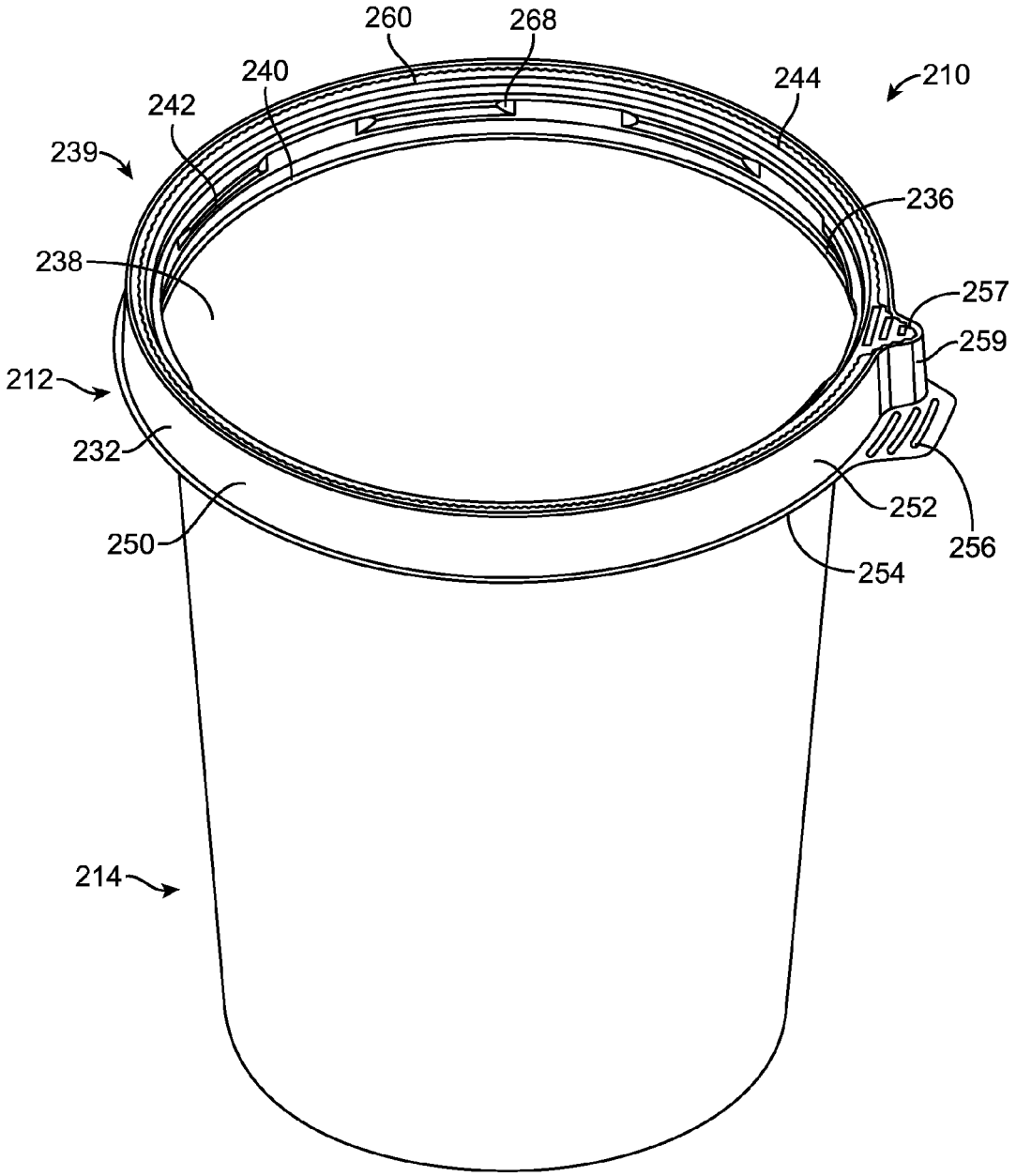
FIG. 26 is perspective view of a container in accordance with yet another embodiment of the present invention.
Figure 27:
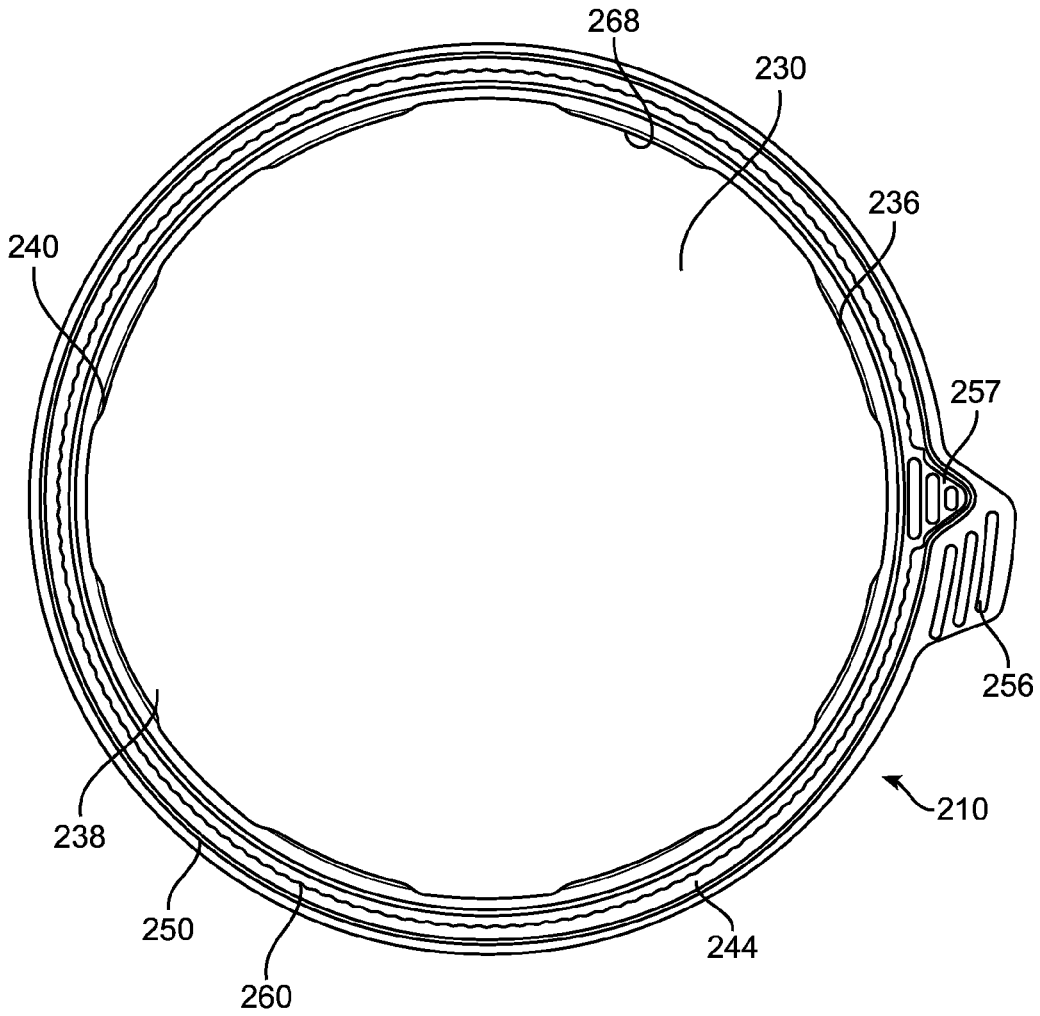
FIG. 27 is a top view of the container of FIG. 26 in accordance with one embodiment of the present invention.
Figure 28:
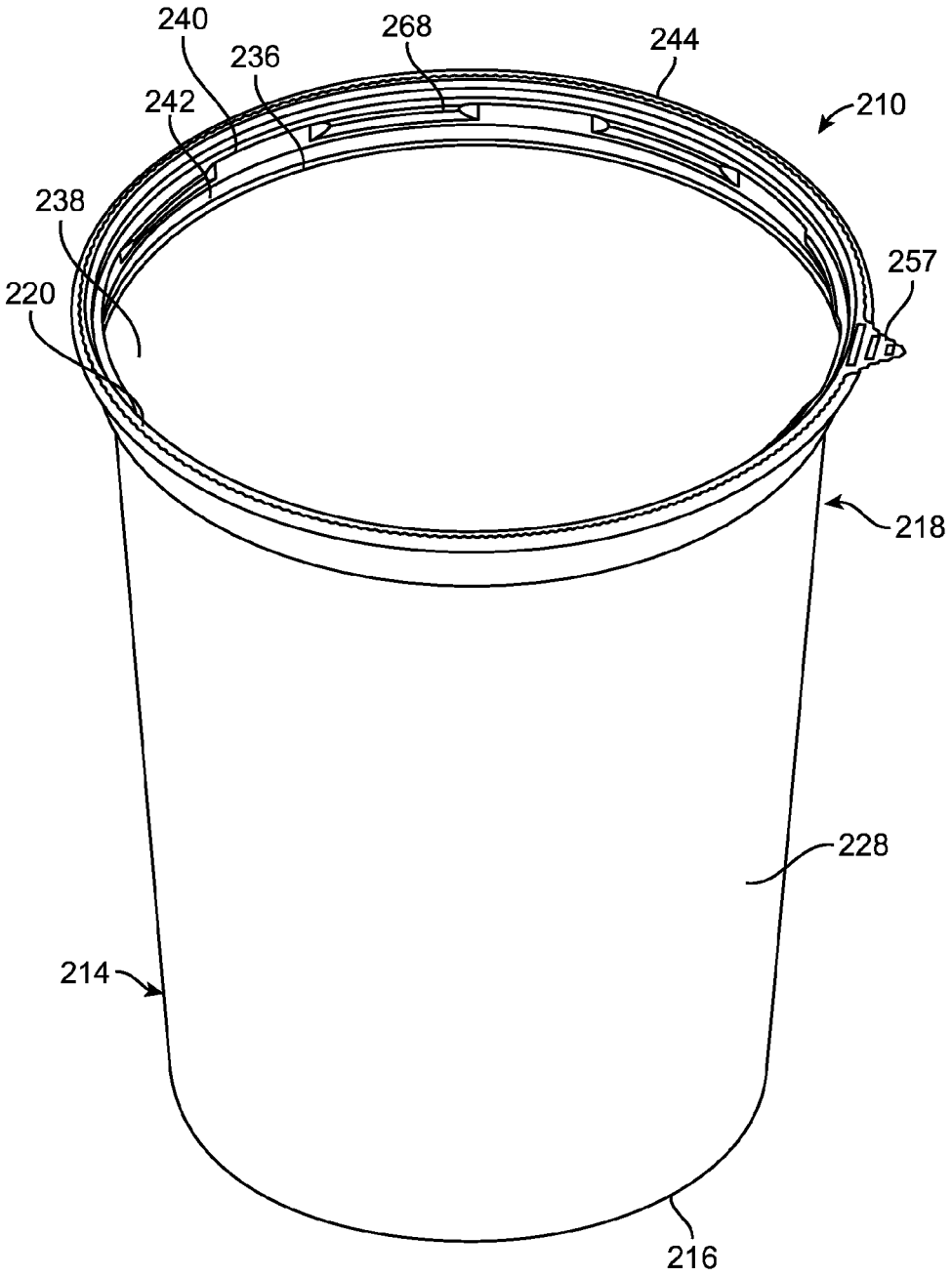
FIG. 28 is perspective view of the container of FIG. 26 having the tear away portion removed in accordance with one embodiment of the present invention.
Figure 29:
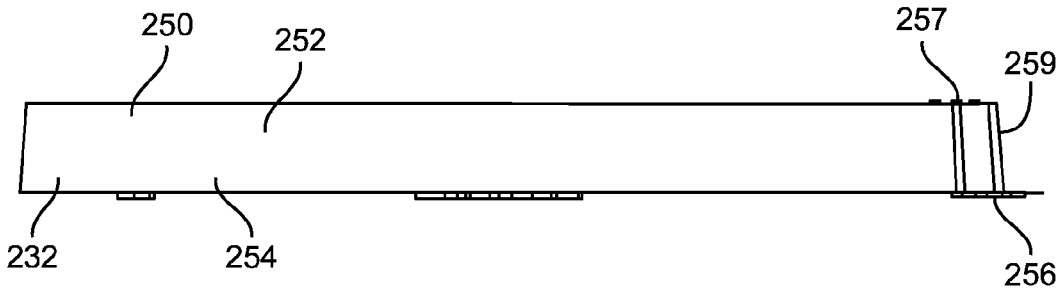
FIG. 29 is side view of the tear away portion of the container of FIG. 26 in accordance with one embodiment of the present invention.
Figure 30:
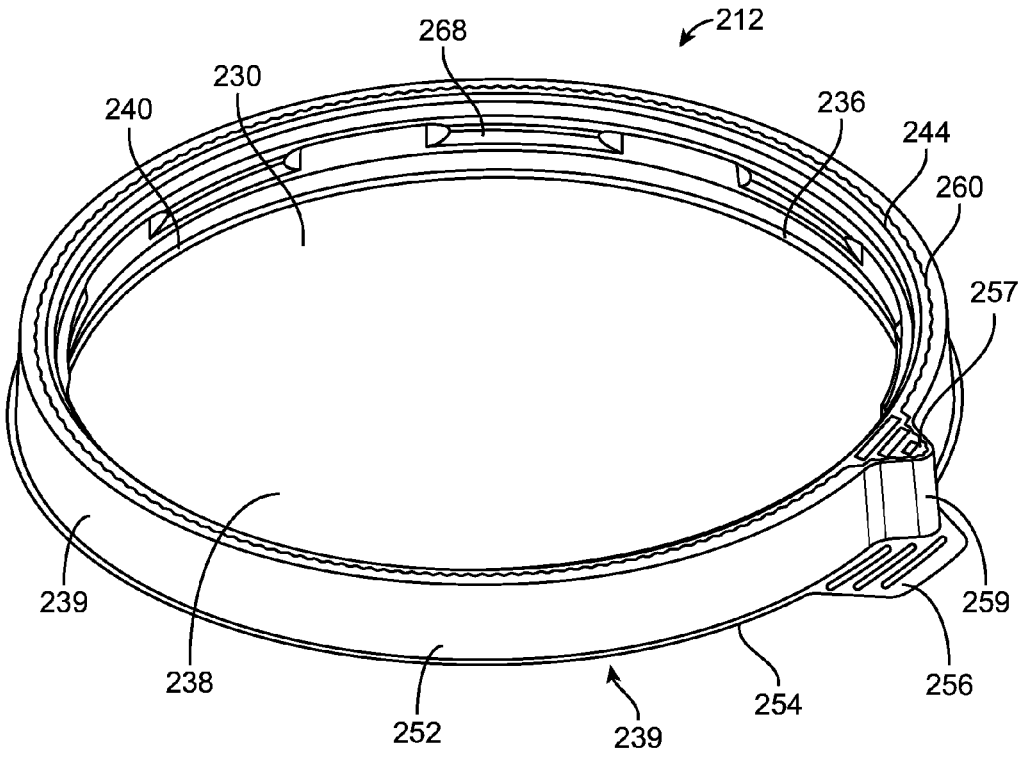
FIG. 30 is a perceptive view of the lid of the container of FIG. 26 in accordance with one embodiment of the present invention.

In the embodiment illustrated in FIG. 24, the depending portion 152 includes a first ridge portion 162 engaging or integral with and extending from the surface 138 at an angle between 60° and 120° but generally at approximately 90° thereto. The friction fit portion 142 further includes a second ridge portion 164 engaging and integral with the shoulder 144 and extending between a ridge 166 and the shoulder 144.

In at least one embodiment, the first ridge portion 162 has a circumference greater than the surface circumference 140, the ridge 166 has a circumference substantially equal to the circumference of the first ridge portion 162, while the second ridge portion 164 has circumference smaller than the circumference of the first ridge portion 162 and/or ridge 166. Further, the lid 112 may include one, two or more indents 168 (one is illustrated) extending about the circumference of the second ridge portion 164 and extending inwardly towards the center of the surface 138. This arrangement of the first ridge portion 162, second ridge portion 164, ridge 166 and/or one or more indents 168 provides good structural support to the lid 112, providing a good friction fit with the tray 114*r*, but enable the lid 112 to be removed.

According to one embodiment, in removing the lid 112 from the tray 114, a user generally grasps either the first tab 156 and/or the extending portion 159, pulling up as provided previously. This action causes the tear away portion 132 to break or tear at the frangible portion 160, resulting in the tear away portion 132 and planar portion 130 forming or breaking into two separate parts, leaving the planar portion 130 engaging and in a friction fit with the tray 114. Note that in this embodiment, this leaves the second tab 157 still connected to the planar portion 130 (best viewed in FIG. 23). This is desirable because it allows for easy removal of the lid 112 during subsequent use.

FIGS. 26-31 depict a container 210 in accordance with another embodiment, similar to that as provided above. More specifically, FIGS. 26-31 illustrate the container 210 including a lid 212 and a body or tray 214. The container 210 may be thermoformed from a suitable polymer, such as polyurethane, polypropylene, polyethylene, polyethylene terephthalate, polyester, polyvinyl chloride, another type of thermoplastic polymer, or a suitable combination of polymers. While the above materials are disclosed, other materials are contemplated. Furthermore it is contemplated that the lid 212 and tray 214 are comprised of the same materials. However, embodiments are contemplated in which lid 212 and tray 214 is comprised of different materials. Furthermore, while a thermoformed process is disclosed, other forming processes are contemplated.

Although the container 210 of the illustrated embodiments is generally cylindrical in shape, it is contemplated that the container 210 may have other suitable shapes including, for example, oval, square, rectangular, and other polygonal or non-polygonal shapes. Further, the container 210 may be sized to hold any suitable amount of contents (e.g., food, liquids, or other items). In at least one embodiment, the width of the container 210 is generally tapered such that the open end 218 has the greatest width, and the bottom end 216 has the smallest width. This tapering feature assists in allowing two or more like containers 210 to be stacked or nested.

As illustrated tray 214 is depicted having a round closed bottom end 216 and a round open end 218 with a lip 220 extending around a circumferential edge, the lip 220 has an inside edge and an outside edge. The tray 214 further includes a sidewall 228 extending between closed bottom end 216 and open end 218.

As illustrated in FIGS. 26-31, lid 212 includes planar portion 230 and the tear away portion 232 in accordance with one embodiment of the present invention. The illustrated lid 212 may be thermoformed from a suitable polymer, such as polyurethane, polypropylene, polyethylene, polyethylene terephthalate, polyester, polyvinyl chloride, another type of thermoplastic polymer, or a suitable combination of polymers. While the above materials are disclosed, other materials are contemplated. Furthermore, while a thermoformed process is disclosed, other processes are contemplated. Although the lid 212 of the illustrated embodiments is generally round in shape, it is contemplated that the lid 212 may have other suitable shapes including, for example, oval, square, rectangular, and other polygonal or non-polygonal shapes.

As illustrated, lid 212 includes a substantially planar portion 230 having a periphery 236 defining a surface 238 and a surface circumference 240. The lid 212 further includes an engagement portion 239 surrounding the periphery 236 and extending therefrom. The engagement portion 239 includes a friction fit portion 242 extending generally upward from the planar surface 238 at surface circumference 240.

Lid 212 further comprises a shoulder 244 that engages and extends from friction fit portion 242. In at least one embodiment, the shoulder 244 defines a plane generally parallel to a plane defined by surface 238.

The tear away portion 232 further includes a tear away portion 250 connected to the friction fit portion 242 at shoulder 244. In at least one embodiment, the tear away portion 232 defines a plane generally parallel to a plane defined by the friction fit portion 242. The tear away portion 250 comprises a depending portion 252 extending generally downward from the shoulder 242 and removably connected thereto.

In one or more embodiments, the depending portion 252 defines a plane generally parallel to the plane defined by the friction fit portion 242. In at least one embodiment the depending portion 252 has a distal end 254 that extends below a plane defined by the planar surface.

Lid 212 further includes a first tab 256; a second tab 257 and an ending portion 259 extending between the first tab 256 and second tab 257. In the embodiment illustrated in FIGS. 26-27 and 30, the first tab 256 has a trapezoidal shape for example extending outwardly from the tear away portion, at distal end 254 for example, while the second tab 257 has a triangular shape and coupled proximate shoulder 244. Extending portion 259 is coupled to the tear away portion 250, extending outwardly there from, and in contact with and engaging both the first tab 256 and the second tab 257. In the illustrated embodiment, the extending portion 259 is similar to or mirrors the shape of the second tab 257.

In at least one embodiment, the tear away portion 250 includes a frangible portion 260 removably engaging the shoulder and the tear away portion 250. In one embodiment, frangible portion 260 extends about the second tab 257. The frangible portion 260 is a perforated section selected from a shape including a wave-form, zig-zag, saw-tooth or a straight line.

Figure 31:
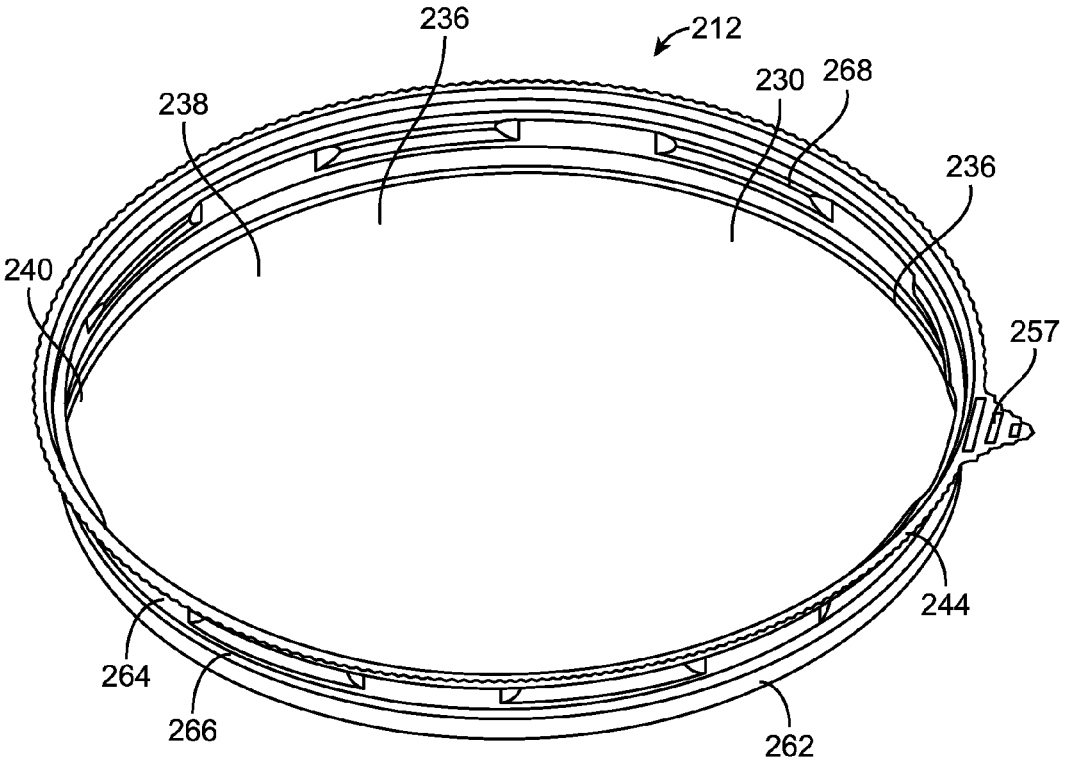
FIG. 31 is a perspective view of the planar portion of the lid of the container of FIG. 26 having the tear away portion removed in accordance with one embodiment of the present invention.

In the embodiment illustrated in FIG. 31 the depending portion 252 includes a first ridge portion 262 similar to that provided previously engaging or integral with and extending from the surface 238 at an angle between 60° and 220° but generally at approximately 90° thereto. The friction fit portion 242 further includes a second ridge portion 264 engaging and integral with shoulder 244 and extending between a ridge 266 and the shoulder 244.

In at least one embodiment, the first ridge portion 262 has a circumference greater than the surface circumference 240, the ridge 266 has a circumference substantially equal to the circumference of the first ridge portion 262, while the second ridge portion 264 has circumference smaller than the circumference of the first ridge portion 262 and/or ridge 266. Further, the lid 212 may include one, two or more indents 268 extending about the circumference of the second ridge portion 264 and extending inwardly towards the center of the surface 238. This arrangement of the first ridge portion 262, second ridge portion 264, ridge 266 and/or one or more indents 268 provides good structural support to the lid 212, providing a good friction fit with the tray 214, but enable the lid 212 to be easily removed and replaced.

According to one embodiment, in removing the lid 212 from the tray 214, a consumer generally grasps either the first tab 256 and/or the extending portion 259, pulling up as provided previously. This action causes the tear away portion 232 to break or tear at the frangible portion 260, resulting in the tear away portion 232 and planar portion 230 forming or breaking into two separate parts, leaving the planar portion 230 engaging and in a friction fit with the tray 214. Note that in this embodiment, this leaves the second tab 257 still connected to the planar portion 230 (best viewed in FIGS. 28 and 31). This is desirable because it allows for easy removal of the lid 212 during subsequent use.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A tamper evident lid formed of a thermoformed material for use with a container comprising:

a round, substantially planar surface having a periphery defining a surface circumference; and an engagement portion surrounding the periphery and extending there from, the engagement portion comprising:

a shoulder;

a friction fit portion extending generally upward from the planar surface; and a tear away portion removably connected to the friction fit portion and being generally parallel to the friction fit portion, the tear away portion comprising a depending portion extending generally downward, the depending portion comprising a first ridge portion engaging the planar surface, a second ridge portion engaging the shoulder and a ridge connecting the first ridge portion and the second ridge portion.

2. The tamper evident lid of claim 1 further comprising the shoulder engaging the friction fit portion and the tear away portion and is generally parallel to the planar surface.

3. The tamper evident lid of claim 2 wherein the tear away portion comprises a depending portion extending generally downward from the shoulder and is removably connected thereto, the depending portion generally parallel to the friction fit portion.

4. The tamper evident lid of claim 3 wherein the depending portion has a distal end that does not extend below the planar surface.

5. The tamper evident lid of claim 4 wherein the distal end is approximately parallel with the planar surface.

6. The tamper evident lid of claim 3 further comprising at least one tab extending outwardly from the tear away portion at the distal end.

7. The tamper evident lid of claim 3 further comprising a first tab extending outwardly from the tear away portion and a second tab extending outwardly from the friction fit portion, the first tab being in spaced relationship to the second tab.

8. The tamper evident lid of claim 3 wherein the tear away portion includes a frangible portion removably engaging the shoulder and the tear away portion.

9. The tamper evident lid of claim 8 wherein the frangible portion is a perforated section selected from a shape including a wave-form, zig-zag, saw-tooth and a straight line.

10. The tamper evident lid of claim 1 wherein the first ridge portion has a circumference greater than the surface circumference.

11. The tamper evident lid of claim 10 wherein the second ridge portion has circumference less than the circumference of the first ridge portion.

12. The tamper evident lid of claim 11 further comprising at least one indent extending from the second ridge portion and towards the center of the planar surface.

13. A tamper evident lid formed of a thermoformed material comprising:

a substantially planar surface having a periphery defining a surface circumference; and an engagement portion surrounding the periphery and extending there from, the engagement portion comprising:

a shoulder;

a friction fit portion extending generally upward from the planar surface;

a shoulder engaging the friction fit portion; and a depending tear away portion removably connected to the shoulder and being generally parallel to the friction fit portion, the depending tear away portion comprising a first ridge portion engaging the planar surface, a second ridge portion engaging the shoulder and a ridge connecting the first ridge portion and the second ridge portion.

14. The tamper evident lid of claim 13 wherein the depending tear away portion extending generally downward from the shoulder and removably connected thereto, the depending tear away portion generally parallel to the friction fit portion.

15. The tamper evident lid of claim 13 wherein a distal end is approximately parallel with the planar surface.

16. The tamper evident lid of claim 13 wherein the depending tear away portion includes a frangible portion removably engaging the shoulder and the tear away depending portion.

17. The tamper evident lid of claim 13 wherein the first ridge portion has a circumference greater than the surface circumference and the second ridge portion has circumference less than the circumference of the first ridge portion.

18. A tamper evident container formed of a thermoformed material, comprising:

a tray comprising:

a round open end having a lip extending around a circumferential edge, the lip having an inside edge and an outside edge;

a round closed end;

a sidewall extending between the open end and the round closed end and defining an interior;

a tamper evident lid formed of for use with the tray comprising:

a round, substantially planar surface having a periphery defining a surface circumference; and an engagement portion surrounding the periphery and extending there from, the engagement portion comprising:

a shoulder;

a friction fit portion extending generally upward from the planar surface; and a tear away portion removably connected to the friction fit portion and being generally parallel to the friction fit portion, the tear away portion comprises a first ridge portion engaging the planar surface, a second ridge portion engaging the shoulder and a ridge connecting the first ridge portion and the second ridge portion.

19. The tamper evident container of claim 18 wherein the first ridge portion has a circumference greater than the planar surface circumference.

20. The tamper evident container of claim 19 wherein the second ridge portion has circumference less than the circumference of the first ridge portion.

* * * * *